US007073264B2

(12) United States Patent
Votolato

(10) Patent No.: US 7,073,264 B2
(45) Date of Patent: Jul. 11, 2006

(54) BAG SLITTING APPARATUS

(75) Inventor: Earl J. Votolato, Newport Beach, CA (US)

(73) Assignee: Earl & Kimberly Votolato Trustees of Votolato Living Trust, Newport Beach, CA (US)

( * ) Notice: Subject to any disclaimer, the term of this patent is extended or adjusted under 35 U.S.C. 154(b) by 68 days.

(21) Appl. No.: 10/010,158

(22) Filed: Nov. 13, 2001

(65) Prior Publication Data

US 2002/0038512 A1 Apr. 4, 2002

Related U.S. Application Data

(63) Continuation of application No. 09/607,477, filed on Jun. 30, 2000, now abandoned.

(51) Int. Cl.
*B67B 7/00* (2006.01)
*B26B 3/00* (2006.01)

(52) U.S. Cl. ..... 30/294; 30/2

(58) Field of Classification Search ..... D7/669; D8/98, 102; 30/2, 278, 280, 294, DIG. 3; 254/28

See application file for complete search history.

(56) References Cited

U.S. PATENT DOCUMENTS

| | | | | | |
|---|---|---|---|---|---|
| 1,082,400 | A | * | 12/1913 | Burnite | 30/289 |
| 2,033,050 | A | * | 3/1936 | Pankonin | 254/28 |
| 2,649,656 | A | * | 8/1953 | Hedrick | 30/287 |
| 2,881,520 | A | * | 4/1959 | Mito | 30/2 |
| D256,883 | S | * | 9/1980 | Wharmby | 30/DIG. 3 |
| D276,786 | S | * | 12/1984 | Chen | D26/133 |
| 4,530,154 | A | * | 7/1985 | DiCarlo | 30/294 |
| 4,581,823 | A | * | 4/1986 | Gilman | 30/280 |
| 4,711,031 | A | * | 12/1987 | Annello | 30/2 |
| D298,210 | S | * | 10/1988 | Hutson et al. | D5/6 |
| 4,887,355 | A | * | 12/1989 | Colbert | 225/19 |
| 5,007,171 | A | * | 4/1991 | Horning, Jr. | 30/2 |
| 5,103,562 | A | * | 4/1992 | Braatz | 30/294 |
| 5,115,568 | A | * | 5/1992 | Aida | 30/289 |
| 5,357,679 | A | * | 10/1994 | Hanna | 30/294 |
| 5,438,759 | A | * | 8/1995 | Dieringer | 30/234 |
| D419,417 | S | * | 1/2000 | Kane | D8/98 |
| 6,578,243 | B1 | * | 6/2003 | Hall | 24/501 |
| 6,658,742 | B1 | * | 12/2003 | Votolato | 30/280 |

FOREIGN PATENT DOCUMENTS

| | | | | |
|---|---|---|---|---|
| GB | 2234699 | * | 2/1991 | 30/2 |

* cited by examiner

*Primary Examiner*—Hwei-Siu Payer
(74) *Attorney, Agent, or Firm*—Rutan & Tucker, LLP

(57) ABSTRACT

A bag slitting apparatus for opening a sealed bag along an edge of the bag. The apparatus has a first arm having first outer and inner surfaces, and a second arm having second outer and inner surfaces. The arms are in tensioned movable opposed relationship to each other such that the first and second inner surfaces are movably positionable against each other. One of these inner surfaces is a bladed inner surface having projecting therefrom a bag cutting blade with a distal blade tip, while the other inner surface has a blade tip receiver. Exteriorly, the first and second outer surfaces are concavedly contoured for simultaneous opposingly-squeezing receipt of a finger and thumb of a user. Placing the edge of the bag between the blade tip and blade tip receiver, squeezing the arms together such that the blade tip pierces the bag and travels to the tip receiver, and thereafter sliding the apparatus along the length of the bag edge produces a slit in the bag through which contents can be retrieved.

3 Claims, 1 Drawing Sheet

BAG SLITTING APPARATUS

CROSS-REFERENCE TO RELATED APPLICATIONS

This is a continuation of application Ser. No. 09/607,477, filed Jun. 30, 2000, now abandoned.

STATEMENT RE: FEDERALLY SPONSORED RESEARCH/DEVELOPMENT (Not Applicable)

BACKGROUND OF THE INVENTION

The present invention relates in general to bag slitting apparatus for opening a sealed bag, and in particular to a bag slitting apparatus for opening a sealed bag along an edge thereof and generally constructed as a spring-tensioned, opposing arm device wherein the inner surface of one arm thereof has a projecting blade for slitting a bag placed between the arms and wherein the outer surfaces of the arms are concavedly contoured for simultaneous opposing receipt of a finger and thumb of a user.

Employment of sealed, usually transparent, plastic bags for housing various products is a well-accepted packaging approach for maintaining such commodities in a ready-to-use condition. Typical products include those produced in food, medical, pharmaceutical, and chemical industries where clean individual-item packaging is generally required. While such sealed bags are highly efficient in maintaining product integrity, access into the interior of a bag for retrieval of a packaged product therein housed many times is not convenient. In particular, a user may need to hand-tear a hole into the bag, or juggle the bag and its housed product while attempting to awkwardly use a cumbersome scissors, utility knife, razor blade, or the like to cut an opening through the bag wall. Not only are such approaches possibly hazardous to the user, they also can be damaging to the product housed in the bag.

In view of the above described obstacles, it is apparent that a need is present for an easily and conveniently usable bag opener. Accordingly, a primary object of the present invention is to provide a conveniently operable bag slitting apparatus for opening a sealed bag along an edge thereof.

Another object of the present invention is to provide a bag slitting apparatus wherein opposing tensioned arm members cooperatively embrace the bag and present a blade there between for slitting the bag during linear apparatus movement.

Yet another object of the present invention is to provide a bag slitting apparatus wherein the opposing tensioned arm members have outer surface portions that are concavedly contoured for simultaneous opposing receipt of a finger and thumb of a user.

These and other objects of the present invention will become apparent throughout the description thereof which now follows.

BRIEF SUMMARY OF THE INVENTION

The present invention is a bag slitting apparatus for opening a sealed bag along an edge of the bag. The apparatus has a first arm having a first outer surface and a first inner surface, and a second arm having a second outer surface and a second inner surface. The first and second arms are in tensioned movable opposed relationship to each other such that the first and second inner surfaces are movably positionable against each other. One of these inner surfaces is a bladed inner surface having projecting therefrom a bag cutting blade with a distal blade tip, while the other inner surface has a blade tip receiver. Exteriorly, the first and second outer surfaces are concavedly contoured for simultaneous opposingly-squeezing receipt of a finger and thumb of a user.

The apparatus is meant to be disposable once the blade tip becomes dull to thereby eliminate inadvertent mishaps such as those which can occur with a conventional utility knife while changing a blade. Depending upon use-environment, the apparatus can be fabricated of autoclavable material to thereby maintain clean-room conditions. Additionally, apparatus construction preferably provides smooth transitions of all surface structures to thereby inhibit contamination and resulting potential cross-contamination during subsequent use. As is apparent, the bag slitting apparatus here defined provides operational utility while supporting convenience, efficiency, and safety in retrieving packaged products.

BRIEF DESCRIPTION OF THE DRAWINGS

An illustrative and presently preferred embodiment of the invention is shown in the accompanying drawings in which.

DETAILED DESCRIPTION OF THE PREFERRED EMBODIMENT

Figure 1:
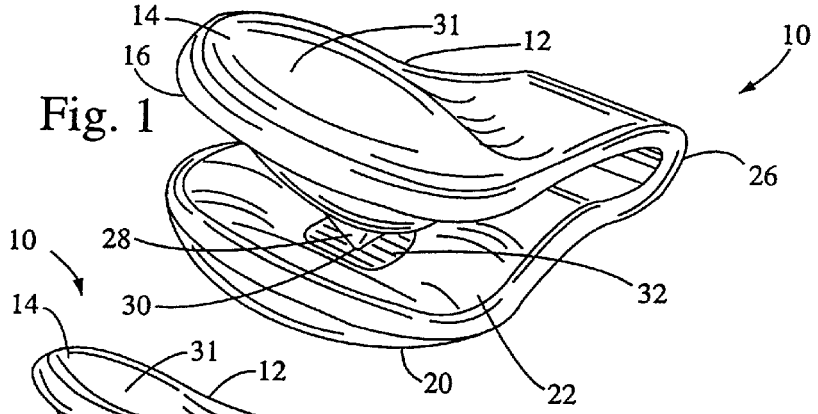
FIG. 1 is a perspective view of a bag slitting apparatus for opening a sealed bag.
Figure 2:
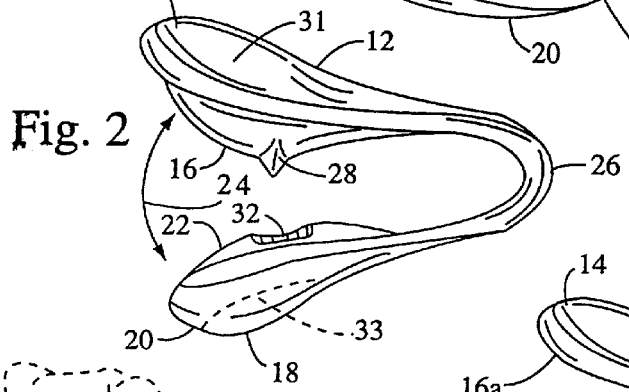
FIG. 2 is a side elevation view of the apparatus of FIG. 1.
Figure 3:
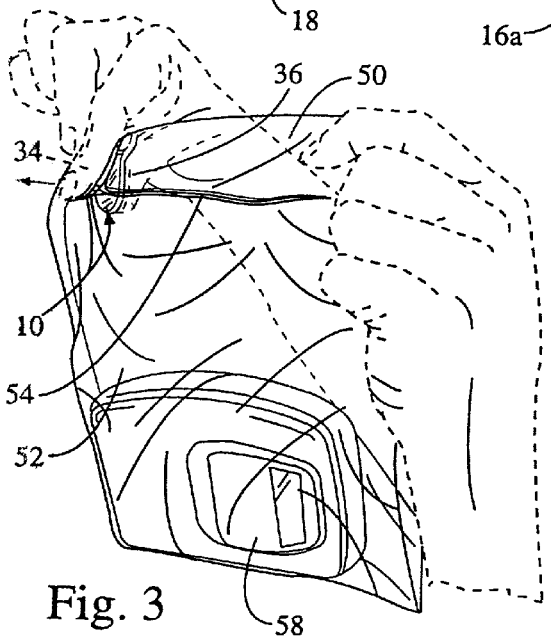
FIG. 3 is a perspective view showing operation of the apparatus of FIG. 1.

Throughout all of the drawing figures, like elements are identically numbered. Referring first to FIGS. 1 and 2, a bag slitting apparatus 10 for opening a sealed bag along an edge thereof is shown. The apparatus 10 has a first arm 12 having a first outer surface 14 and a first inner surface 16, and a second arm 18 having a second outer surface 20 and a second inner surface 22. The first and second arms 12, 18 are in tensioned movable opposed relationship to each other such that the first and second inner surfaces 16, 22 are movably positionable against each other as indicated by the arrow 24 of FIG. 2. Such tensioned relationship is conventionally attained by kinetically stressing the bridge 26 joining the arms 12, 18 as known in the art. The first and second arms 12, 18 are each significantly wider than the bridge 26, and the entirety of the first and second arms 12, 18 extend concavely from the bridge 26. One of the inner surfaces, here shown as the first inner surface 16, is a bladed inner surface having projecting therefrom a bag cutting blade 28 with a distal blade tip 30, while the other inner surface, here shown as the second inner surface 22, has a blade tip receiver here shown as a surface-disposed groove 32 in alignment with the blade tip 30. The surface-disposed 32 is curved. As shown in the embodiment of FIGS. 1–3, the apparatus 10, including the blade 28, is fabricated as a single piece of rigid plastic. The first and second outer surfaces 14, 20 are concavedly contoured distally for simultaneous opposing receipt of a finger 34 and thumb 36 (FIG. 3) of a user.

Figure 4:
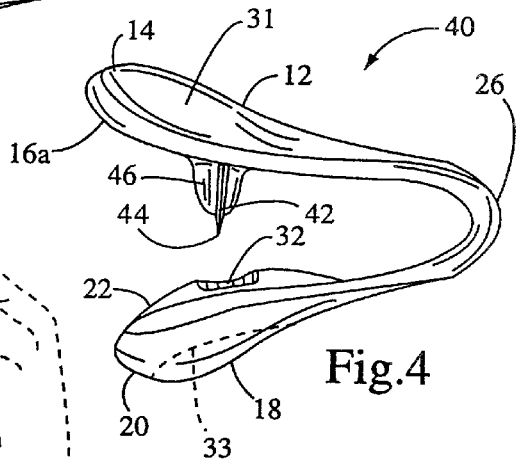
FIG. 4 is a side elevation view of a second embodiment of a bag slitting apparatus for opening a sealed bag.

FIG. 4 illustrates a second embodiment of a bag slitting apparatus 40 whose construction is identical to that described above for the embodiment of FIGS. 1–3 except for having a separate blade 42 fabricated of metal such as steel. The blade 42 is accommodated within, and has a tip 44 projecting from, a housing 46 protruding from the first inner surface 16*a*. The entire apparatus 40, except for the blade 42, is fabricated as a single piece of rigid plastic. Retention of the blade 42 within the housing 46 is accomplished by friction fit and/or adhesive as known in the art.

Operation of either of the apparatus 10, 40 is shown in FIG. 3, and is specifically exemplified by the apparatus 10. As is there shown, the concavedly contoured portions 31, 33 of the first and second outer surfaces 14, 20 are grasped by a finger 34 and thumb 36 of a user, and an edge portion 50 of a plastic bag 52 is positioned between the blade tip 30 and groove 32 (FIGS. 1 and 2). The first and second arms 12, 18 are squeezed toward each other and the blade tip 30 pierces the bag 52 to terminate movement within the groove 32. Once such engagement is accomplished, the apparatus 10 is moved along the length of the edge portion 50 of the bag 52 to thereby produce a slit 54 through the bag 52. The apparatus 10 is then removed, and the user can reach through the slit 54 into the bag 52 and retrieve a product 58 therein packaged. In this manner, the bag 52 is efficiently and safely opened, and the apparatus 10 is immediately ready for re-use in opening subsequent bags as needed.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A bag slitting apparatus for opening a sealed bag, comprising:

first and second arms forming a single piece of material that are connected only through a pivoting bridge at one end, and wherein the arms have outer surfaces that are concavely contoured distally for simultaneous receipt of a finger and a thumb of a user; and the entirety of the first and second arms extending concavely from the bridge the first arm carrying a cutting surface on an interior surface facing the second arm;

the second arm carrying a curved receiving surface that cooperates with the cutting surface to make a cut through a portion of the bag when the first and secord arms are opposed about the bag, and wherein the first and second arms are each distally significantly wider than the bridge.

2. A bag slitting apparatus as claimed in claim 1 wherein the arms and the bridge are fabricated as a single piece of plastic.

3. A bag slitting apparatus as claimed in claim 2 wherein the cutting surface is an edge of a metal blade.

* * * * *